US007055768B1

(12) United States Patent
Stratton et al.

(10) Patent No.: US 7,055,768 B1
(45) Date of Patent: Jun. 6, 2006

(54) ROTARY DEVICE FOR TRANSMISSION OF MATERIAL IN PARTICULATE FORM

(76) Inventors: John David Stratton, 6A New Road, Ashurst, Southampton, Hampshire (GB) ST4 2BS; Robert Dennis Taylor, Green Cottage, Green Lane, Holberrow Green, Worchestershire (GB)

( * ) Notice: Subject to any disclaimer, the term of this patent is extended or adjusted under 35 U.S.C. 154(b) by 1068 days.

(21) Appl. No.: 09/744,664

(22) Filed: Sep. 18, 2000

Related U.S. Application Data

(63) Continuation of application No. PCT/GB98/01675, filed on Jun. 8, 1998, now abandoned.

(30) Foreign Application Priority Data

May 23, 1997 (DE) ..... 197 21 615
Mar. 27, 1998 (GB) ..... 9806709

(51) Int. Cl.
*B05B 5/00* (2006.01)

(52) U.S. Cl. ..... 239/700; 239/223

(58) Field of Classification Search ..... 239/700, 239/703, 214–214.19, 215, 216, 222.11, 222.13, 239/222.15, 223
See application file for complete search history.

(56) References Cited

U.S. PATENT DOCUMENTS

| | | | | |
|---|---|---|---|---|
| 2,473,035 A | | 6/1949 | Meade et al. | |
| 3,669,514 A | | 6/1972 | Wada et al. | |
| 3,796,472 A | | 3/1974 | Fernlund | |
| 4,113,416 A | * | 9/1978 | Kataoka et al. | 431/1 |
| 4,318,941 A | * | 3/1982 | Gillett et al. | 427/212 |
| 4,407,217 A | * | 10/1983 | Jackson | 118/24 |
| 4,710,034 A | | 12/1987 | Tittizer et al. | |
| 5,634,326 A | | 6/1997 | Wanger | |
| 5,788,164 A | * | 8/1998 | Tomita et al. | 239/700 |
| 6,585,169 B1 | * | 7/2003 | Andersson | 239/7 |

FOREIGN PATENT DOCUMENTS

| | | |
|---|---|---|
| DE | 3901804 C1 | 4/1990 |
| DE | 195 17 477 A1 | 11/1996 |
| EP | 0 052 952 A1 | 6/1982 |
| EP | 0 109 224 | 5/1984 |
| EP | 0 246 032 | 11/1987 |
| EP | 0 508 771 A1 | 10/1992 |
| EP | 0 780 159 A1 | 6/1997 |

(Continued)

OTHER PUBLICATIONS

Patents Abstracts of Japan M-544 Dec. 1986 vol. 10/No. 372; 61-165015, Inahata "Pneumatic Elevating Device".

(Continued)

*Primary Examiner*—Christopher Kim
(74) *Attorney, Agent, or Firm*—Nixon & Vanderhye PC

(57) ABSTRACT

A device for transmitting a beam of material in particulate form for example for use as an atomized particle paint sprayer comprises an outer bell-shaped member which is rotatable about a principal axis and arranged to project a conical curtain of small particles flowing generally towards a target, a supply system for supplying material from a reservoir source to an internal shaping region of the outer bell-shaped member to create the conical curtain of small particles there being an inner rotary bells-shaped member which is provided coaxially with the outer bells-shaped member so that at least a major part of the material emerging from the supply system is subject to differing rotary forces imparted by both the inner and outer rotary bell-shaped members.

13 Claims, 1 Drawing Sheet

FOREIGN PATENT DOCUMENTS

| | | |
|---|---|---|
| FR | 1.274.814 | 11/1959 |
| FR | 1.224.667 | 6/1960 |
| FR | 1.472.066 | 3/1967 |
| GB | 471865 | 9/1937 |
| GB | 663634 | 12/1951 |
| GB | 685871 | 1/1953 |
| GB | 865765 | 4/1961 |
| GB | 960102 | 6/1964 |
| GB | 1 515 511 | 6/1978 |
| GB | 2 008 439 A | 6/1979 |
| GB | 1 597 349 | 9/1981 |
| GB | 2 142 559 A | 1/1985 |
| GB | 2 197 224 A | 5/1988 |
| GB | 2 271 069 A | 4/1994 |

OTHER PUBLICATIONS

Patents Abstracts of Japan Jan. 1980; 55011064, Masashi "Rotary Type Electrostatic Coater for Conductive Paint".

* cited by examiner

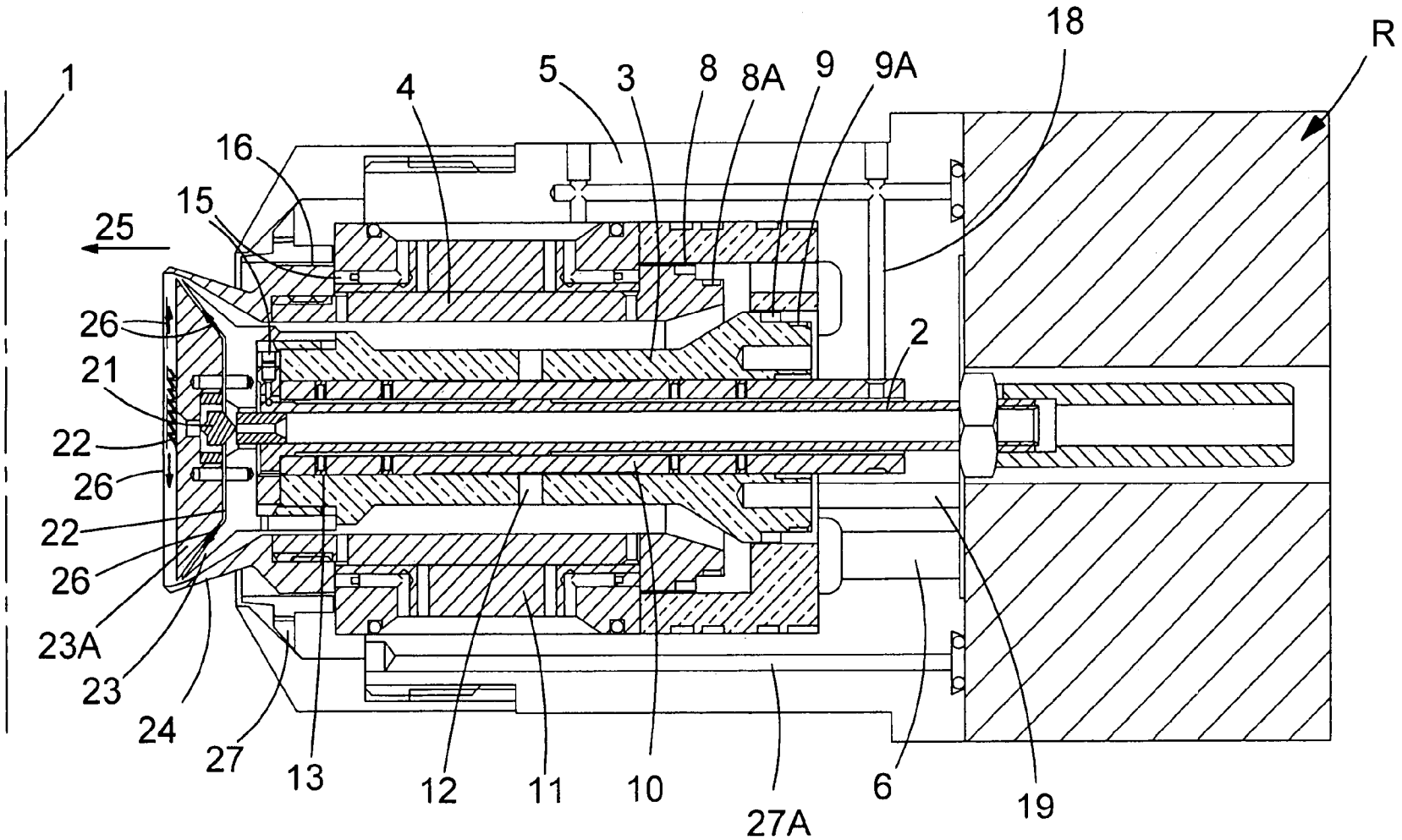
R
18
9A
9
8A
8
3
5
4
16
15
25
1
2
19
6
27A
10
11
12
13
27
24
23
23A
26
21
22
26
22
26

ROTARY DEVICE FOR TRANSMISSION OF MATERIAL IN PARTICULATE FORM

This is a continuation of International Application PCT/GB98/01675, with an international filing date of Jun. 8, 1998, now abandoned.

The present invention relates to rotary devices for transmitting material in particulate form particularly for deposition on a surface. The material may be a solid, a liquid, a gel, a powder or a suspension when supplied, but is or becomes particulate when airborne.

Rotary devices are known, for example electrostatically controlled atomising paint spraying devices, where the material to be deposited is forced through a high speed rotary bell-shaped outlet which atomises and directs the material as a conical beam onto a surface while assisted by a high voltage electrostatic charge between the surface and the particles.

Generally the material to be deposited, such as paint, will be a liquid or suspension, but other suspended materials, solids and powders can be handled in this way dependent on the application provided they are able to be in particulate form when airborne.

There are various design problems associated with provision of an efficient rotary deposition device.

It is desirable that an accurate beam of atomized material is achieved with minimum energy input, and for certain applications it is desirable that the unit should be small, light and controllable, particularly when it is to fit on the end of a robot arm R.

To this end a conical or cylindrical curtain of high velocity air can be supplied so as to encircle the emerging conical beam or mist of atomised particles. This constrains the beam so as to re-shape the beam into a more closely confined and accurate spray.

However a problem arises in that the velocity required for the shaping air curtain needs to relate to the particle velocity required for adequate atomisation. Otherwise there is a risk of damage of the mist shape and coagulation of the mist particles.

According to one aspect of the invention therefore there is provided a device for transmitting a beam of material in particulate form, comprising an outer bell-shaped member which is rotatable about a principal axis and arranged to project a conical curtain of small particles flowing generally towards a target, supply means for supply of material from a reservoir source and centrally outwards from said principal axis and towards a peripheral internal shaping region of said outer bell-shaped member to create said conical curtain of small particles characterised in that an inner rotary bell-shaped member is provided co-axially with said outer bell-shaped member and is arranged to rotate at a different rate to that of said outer bell-shaped member so that at least a major part of the material emerging from said supply means is subject to differing rotary forces imparted by both the inner and outer rotary bell-shaped members.

Generally for best results an inner surface of the outer bell-shaped member in an operative region where it receives emergent material for atomisation should be roughened. Also it is desirable that the outer bell-shaped member should in its operative region extend outwardly of the inner bell-shaped member.

Use of two bell-shaped members has the immediate advantage that the velocities required for adequate atomisation or mist production can be substantially reduced. This means that if an external air curtain is to be used, the differences in velocity of the mist particles and of the air curtain can be reduced, and so better results can be achieved.

Generally the two bell-shaped members will rotate in opposing directions, but that is not always to be preferred. In some cases rotation in the same direction but at significantly different rates will be effective.

Other benefits of reduced velocity are that less energy is required, and that—even in the absence of an external air curtain—the conical beam will be subject to less external scattering since the centrifugal velocity energy of the particles (dependent on the square of the velocity) will be reduced.

Another advantage is that the difference in speeds of the two bell-shaped members can be adjusted if desired in order to optimise performance of the device. If this is required, the two bell-shaped members should be independently adjustable in speed.

Preferably a centrally located diffuser disc is provided externally to said supply means and perpendicular to said principal axis and includes a centrally located deflector which deflects at least some of the emergent material into contact with an internal surface of said inner bell-shaped member and thence to an internal surface of the outer bell-shaped member. The rotary diffuser disc may be integral with the inner bell-shaped member so as to rotate integrally with it. Preferably the remainder of said material is arranged to be passed through apertures in said disc and onto an external face of said disc and then to be fed centrifugally into the region of said peripheral internal shaping region of said outer bell-shaped member.

Generally it is preferred to provide an external cylindrical or conical curtain of air surrounding said beam of particles. Since air under an elevated pressure is required for this purpose, it is convenient to use the same air pressure source for other functions within the device.

The two rotary bell-shaped members can be rotated by any suitable driven rotor system, but the use of air pressure is particularly convenient. Thus the bell-shaped members can form part of, in each case, an air turbine. Also, air bearings utilising air under pressure can, if desired, be used to support rotation of the rotary parts of the device. However it is an important preferred feature of the invention that these bearings should be supplied with air separately from the air turbines to avoid undesired interactions, that is separate conduits are provided for the air turbines and for the bearings.

The device operates most effectively when there is a high voltage electrostatic charge between the particles and their target. This can, if desired, be achieved by earthing the target and applying a high voltage to the emerging particles or to the material prior to its becoming particulate.

In a convenient form of the invention the voltages required can be generated internally within the device. If a rotary member carries conductors or magnets and a static part of the device carries the converse, an electric generator arises and the resultant generated voltage can be arranged to charge the particles.

The device is of particular advantage when used in a painting (coating) tool with two turbines incorporating the bell-shaped members and driven by compressed air, which enclose a central tube carrying the deposition material which is then forced outwardly towards the turbines. Both bell-shaped members produce a form of centrifugal acceleration of the paint particles which are at least partially atomised as they strike against the inner surfaces of the bell-shaped members. The atomised particles are then propelled in the general direction of the object to be painted (coated). The resulting coating has a characteristically very smooth and even surface profile.

Both turbines are supported preferably on air bearings. The compressed air can be fed to each turbine through an inlet or inlets in the casing and which then exits to atmosphere, and can be supplied separately and in parallel, in each case to a hollow cylinder bearing downstream from the turbine drive in a parallel operation which also exits to atmosphere.

It was found that counter rotation of the two turbines reduces the required speed considerably while improving the quality of the coating. Conventional turbine driven paint tools rotate at a speed ranging from 16,000 $min^1$ and 70,000 $min^1$ while counter-rotation enables the speed of each turbine to be reduced to approximately 10,000 $min^1$, or in some cases as low as 5,000 $min^1$. As a result, the size and weight of the turbines can be reduced. The propelled compressed air is able to have a lower kinetic energy content which ultimately means that the volume of the compressed air generating blower or ventilator can be reduced. All these factors play a decisive role if the output of the paint (coating) application tool has to be directed very precisely over the object to be coated, as is the case for instance, for vehicle bodywork paint spraying systems.

A desirable aim in many cases is to reduce weight and to this end it is preferable that when perforated hollow cylinders are used to provide air bearings, the cylinders are of plastics or ceramic materials. For a quick and economical change of coating medium, e.g. the colour of a car paint, the components carrying the coating medium may be in the form of a ceramic, metal or composite outer casing having suitably selected surface properties.

An embodiment of the invention will now be described by way of example with reference to the accompanying drawing.

The FIGURE shows a longitudinal section through a coating tool. The surface to be painted is labelled 1, and is located at a distance from the tool which is dependent on the application parameters to be used. The tool essentially comprises a central tube 2, which carries a coating medium which has been supplied from an external supply source, an inner turbine 3 an outer turbine 4, together with supporting bearings (in this case air bearings) 10 and 11 and a fixed casing 5.

Both turbines are driven by compressed air which passes from the rear of the casing via conduits to the turbine blades 8 and 9, through separate supply holes. Similar supply connections and conduits are provided for reverse or braking motion of the turbines 8A and 9A. The impact surfaces of the turbine blades 8 and 9 are so arranged that the turbines 3 and 4 rotate in a counter direction to one another.

In the case described, the bearings provide both axial and radial support for the turbines by the use of air, supplied from a connection on the housing through numerous controlled conduits or passageways 15 and 13, quite separate from and in parallel with the conduits for the turbines, to accurately controlled voids between the static and rotating surfaces. The air then exhausts through passage 6. The turbines 3 and 4, thus supported are centred and free to rotate on air bearings while having no physical contact with each other or their bearings, or the casing 5.

Carried at the ends of the turbines 3 and 4 are bell shaped members 23 and 24. These are arranged so as to rotate concentrically, with the end of the inner bell shaped member 23 being inside the outer bell shaped member 24, and the outer bell-shaped member extending beyond the front edge of the inner bell-shaped member. In the case described, the outer bell shaped member has an inner surface, at its end which is of a selected shape and roughness 24A to promote atomisation, while the inner bell shaped member incorporates a conical diffuser 21 and a transfer disc 23A, which are integral with the inner bell-shaped member and therefore rotate integrally with it. The roughened surface of the outer bell-shaped member should extend from a region opposite the tip of the inner bell-shaped member to the outermost end, or tip, of the outer bell-shaped member.

At the end of the medium supply tube 2 is a controlled orifice which ejects the coating medium onto the diffuser 21 which is revolving as part of the inner bell shaped member 23, 23A. This diverts a proportion of the medium through a controlled gap between the inner bell shaped member 23 and the transfer disc 23A while allowing the remainder to pass through a hole or holes in the transfer disc, to the front of the rotary transfer disc 23A.

By virtue of the centrifugal forces exerted on the coating medium by the rotational movement, the medium passes, either side of the transfer disc, to be thrown from the tip in a generally radial trajectory 26. The spray thus produced, now impinges on the roughened inner surface of the outer bell shaped member 24A which has the effect of "atomising" and shaping the trajectory of the droplets.

The cone of mist may then be subjected to the effects of shaping from the air curtain produced by the controlled passage of air through a shaping air ring 27, via supply line 27A.

The application of a high electrostatic potential between the coating medium and the target 1 will enhance the performance. This electrostatic charge can be applied outside the tool (via electrodes penetrating the mist) or inside via a connection to the paint tube from an externally or internally generated source, and can be applied to the medium prior to, during or after atomisation.

Various other features may be included in the tool, such as speed indication (and control via external equipment). This is achieved by the feedback of optical, electrical, pneumatic or audible signals to a suitable output device from the turbines.

Hole 19 on the drawing is an access for a pin to lock the turbine to facilitate removal and replacement of the bell.

The application of a high voltage between the tool and the surface 1 which produces an electrostatic acceleration of the atomised paint particles, is not shown. This can as previously mentioned be supplied from an external source or it can be generated by the counter-rotation movements of the outer and inner turbines 4 and 5 to allow this high voltage to be generated using a generator effect arising from the relative movement of these components.

The invention is not limited to the exemplary design described above. A number of variants is conceivable which are able to make use of features of the invention, even where some aspects of detail may be different.

The invention claimed is:

1. An electrostatically controlled device for transmitting a beam of material in particulate form at a target surface to be coated, said device comprising: an outer bell-shaped member which is rotatable about a principal axis and arranged to project a conical curtain of small particles flowing generally towards said target surface;

a supply system for supplying material from a reservoir source towards a peripheral internal shaping region of said outer bell-shaped member;

an inner rotary bell-shaped member provided coaxially with said outer bell-shaped member and arranged to rotate differently to said outer bell-shaped member so that at least a major part of the material supplied by said supply system is subject to differing rotary forces imparted by the inner and outer rotary bell-shaped members; and a centrally located rotary diffuser disc for transmission of said material from said supply system to the inner rotary bell-shaped member, said disc having at least one aperture therethrough so that some of said material supplied by said supply system can pass through said aperture and onto an external face of said disc so as to be forced outwards centrifugally towards the outer bell-shaped member.

2. A device as claimed in claim 1, in which each bell-shaped member is integral with an air turbine which is driven by air pressure to rotate said bell-shaped member.

3. A device as claimed in claim 2, in which each bell-shaped member is arranged to be supported and rotated on air bearings, and the bearings are supplied with air via conduits which are separate from conduits supplying air to the air turbines, so that the bearings are supplied with air separately from the air turbines.

4. A device as claimed in claim 1, which includes a centrally located rotary deflector which is arranged to deflect at least some of said material supplied by said supply system into contact with an internal surface of said inner bell-shaped member.

5. A device as claimed in claim 4, in which said diffuser disc and said deflector are integral with said inner bell-shaped member so as to rotate therewith.

6. A device as claimed in claim 1, further comprising an air shaping ring for provision of a shaping curtain of air emanating to encircle and control said conical curtain of small particles.

7. An electrostatically controlled coating device comprising:

a first rotary bell-shaped member having an axis of rotation and an internal shaping region arranged to project a conical curtain of particulate material towards a target surface;

a supply system for conducting said material towards said first rotary bell-shaped member; and a distributor arrangement for distributing said material from said supply system onto said internal shaping region, said distributor arrangement comprising a second rotary bell-shaped member disposed inwardly of said first rotary bell-shaped member and coaxial therewith and a rotary disc associated with said second rotary bell-shaped member and defining at least one through-hole leading from an inner face of said disc which faces said second rotary bell-shaped member to an outer face of said second rotary bell-shaped member which faces away from said second rotary bell-shaped member, the arrangement being such that a first portion of said material from said supply system is distributed to said internal shaping region via an internal surface of said second rotary bell-shaped member and a second portion to said material from said supply system is distributed to said internal shaping region via said at least one through-hole and said external face, and wherein said first and second rotary bell-shaped members rotate differently such that at least a major part of said particulate material is subject to differing rotary forces imparted by said first and second rotary bell-shaped members.

8. A device as claimed in claim 7, wherein said first and second rotary bell-shaped members rotate in opposite directions.

9. A device as claimed in claim 7, further comprising a deflector arranged to deflect said first portion of said material onto said internal surface of said second rotary bell-shaped member.

10. A device as claimed in claim 9, wherein said rotary disc and said deflector are connected with said second rotary bell-shaped member so as to be rotatable therewith.

11. A device as claimed in claim 7, wherein said disc is a frusto-conical disc disposed within said second rotary bell-shaped member and cooperable with said internal surface to define a passage for said first portion of said material.

12. A device as claimed in claim 7, further comprising respective air turbines for said rotary bell-shaped members, respective air bearings for said air turbines, and separate air supply conduits to said air bearings and said air turbines whereby said air bearings are supplied separately of said air turbines.

13. In combination, a robot arm and an electrostatically controlled device for transmitting a beam of material in particulate form at a target surface to be coated, said device comprising:

an outer bell-shaped member which is rotatable about a principal axis and arranged to project a conical curtain of small particles flowing generally towards said target surface;

a supply system for supplying material from a reservoir source towards a peripheral internal shaping region of said outer bell-shaped member;

an inner rotary bell-shaped member provided coaxially with said outer bell-shaped member and arranged to rotate differently to said outer bell-shaped member so that at least a major part of the material supplied by said supply system is subject to differing rotary forces imparted by the inner and outer rotary bell-shaped members; and a centrally located rotary diffuser disc for transmission of said material from said supply system to the inner rotary bell-shaped member, said disc having at least one aperture therethrough so that some of said material supplied by said supply system can pass through said aperture and onto an external face of said disc so as to be forced outwards centrifugally towards the outer bell-shaped member, and wherein said device is mounted on said robot arm.

* * * * *